US007175236B1

(12) United States Patent
Pfaff

(10) Patent No.: US 7,175,236 B1
(45) Date of Patent: Feb. 13, 2007

(54) HAMMER FOR BREAKING CONCRETE

(75) Inventor: Deems M. Pfaff, Vail, CO (US)

(73) Assignee: Road Processing Resources, Inc., Vail, CO (US)

( * ) Notice: Subject to any disclaimer, the term of this patent is extended or adjusted under 35 U.S.C. 154(b) by 0 days.

(21) Appl. No.: 11/247,861

(22) Filed: Oct. 11, 2005

Related U.S. Application Data

(60) Provisional application No. 60/618,073, filed on Oct. 12, 2004.

(51) Int. Cl.
*B25D 9/02* (2006.01)

(52) U.S. Cl. ..... 299/37.5

(58) Field of Classification Search ..... 299/37.3, 299/37.4, 101
See application file for complete search history.

(56) References Cited

U.S. PATENT DOCUMENTS 1,891,221 A * 12/1932 Cornett ..... 299/37.4
3,381,764 A * 5/1968 Peterson et al. ..... 299/37.3
3,627,064 A * 12/1971 Sjoberg et al. ..... 299/37.4
5,607,022 A * 3/1997 Walker et al. ..... 173/10
6,702,037 B1 * 3/2004 Thiessen ..... 173/89

* cited by examiner

*Primary Examiner*—John Kreck
(74) *Attorney, Agent, or Firm*—Steven E. Kahm; Nikolai & Mersereau, P.A.

(57) ABSTRACT

The hammer impact cracks the concrete, then separates the concrete from the steel and creates concrete aggregate. The hammer has a pair of arms with an angled portion for sliding on an angled portion of guide plates, which have a long surface in contact with the hammer arms to provide a stable movement of the hammer without sideways motions. The hammer can be a gravity drop hammer or a compressed gas accelerated hammer. The hammer can pivot to adjust the blows to be perpendicular to the surface being impacted. The pivot also helps in retracting the hammer from the concrete to unjam it therefrom particularly when the concrete is moving relative to the hammer. The pivotable hammer is useful for transporting the hammer and for maintenance work on the hammer. The hammer has teeth to increase the shock of impact to crack and then break the concrete along the cracks.

6 Claims, 2 Drawing Sheets

HAMMER FOR BREAKING CONCRETE

This application claims priority to provisional application 60/618,073, filed 12 Oct. 2004.

BACKGROUND OF THE INVENTION

1. Field of the Invention

This invention relates to hammers and more particularly to a hammer and anvil principle for processing concrete into aggregate using the phenomena of shock to separate steel reinforcements.

2. Description of the Related Art

When concrete roads are broken up and turned into aggregate, jackhammers and other powered hammers are used to break up the concrete roadbed. The jackhammers create large chunks of concrete, with steel rods holding the chunks together. The steel rods or mesh have to be cut and the chunks of concrete have to be sent to a crushing machine to create aggregate and separate out the steel rods. Similarly with thick concrete products such as building walls for tilt up construction buildings or concrete floors, concrete beams and concrete columns used in buildings the demolition of the building has been done with wrecking balls to smash the concrete. Steel rods in the concrete hold the broken chunks of the building together and must be cut. The building now in smaller pieces which can be hauled to a crusher for making aggregate and separating out the steel rods. Alternatively the smaller pieces are buried in a landfill.

The process of breaking up roads, buildings and other objects having concrete with reinforcing rods is expensive and labor intensive. It is desirable to have an automated processing of reinforced concrete to turn the concrete into reusable aggregate and recycle the steel rods. In order to accomplish this goal a concrete hammer for cracking concrete and breaking it apart is needed. The principle usage of this type of hammer is in conjunction with an anvil with a mass of four times that of the hammer mass.

SUMMARY OF THE INVENTION

A hammer for breaking concrete into aggregate for use with roads or other thick concrete products such as concrete walls, floor, beams and columns has been developed. The hammer is portable so it can get to job sites. The hammer impacts concrete, which moves below it either continuously or incrementally and can process large quantities of concrete into aggregate while removing the concrete from the steel reinforcement, which can be cut into small lengths and recycled by scrap dealers.

The hammer can be a gravity drop hammer with a hydraulic cylinder to lift the hammer or a duplex hydraulic cylinder for lifting the hammer and compressing $N_2$ for accelerating the hammer during its down stroke. The hydraulic cylinder compresses the $N_2$ when lifting the hammer to provide the compressed gas used during the down stroke.

The hammer is rectangular with a pair of arms as sides and a space therebetween for the hydraulic cylinder. The hammer is slidingly supported by front and rear guide plates on the inside perimeter of the rectangle. The arms of the hammer have an angled portion for engaging an angled portion along the length of the guide plates for a large sliding contact area for stabilizing the hammer to reduce side thrusts, vibrations and loss of energy.

The hammer assembly is mounted on a pivot for tilting the hammer to angle the blows of the hammer to meet the angle of the surface of the concrete to be broken up. The hammer uses an anvil, which may be sloped in some applications such as pavement recycling. The hammer therefore may have to be adjusted to the angle of the anvil. Further the hammer may have to be tilted down for transporting the hammer to different sites or to provide easy access for maintenance. The pivot is also useful to change the angle of the hammer if it gets stuck in the concrete and needs to be angled to help pull the hammer out of the concrete. This may be very useful when the concrete is moving relative to the hammer as when continuously processing a road surface on a moving vehicle or when a successive hammer blow from an adjoining hammer moves concrete adjacent to the hammer tending to jam the hammer in the concrete.

The hammer foot preferably has a staggered tooth pattern for increasing the separating and sizing of the concrete. The teeth concentrate the shock which, helps break up the concrete by creating cracks therein and also increases the force applied to pieces of concrete for breaking off the concrete along the cracks.

OBJECTS OF THE INVENTION

It is an object of the invention to crack concrete and fracture it into aggregate.

It is an object of the invention to separate concrete from steel reinforcement rods or mesh.

It is an object of the invention to use an anvil with the hammer to provide a shock to the concrete for cracking the concrete by dissipating the full kinetic energy of a moving mass.

It is an object of the invention to angle the blows of the hammer to increase the efficiency of hammer blows.

It is an object of the invention to pivot the hammer to make it easier to remove the hammer from the concrete after a blow.

It is an object of the invention to increase the impact of each blow by using a compressed gas to accelerate the hammer on its down stroke.

It is an object of the invention to increase the rate of concrete cracking and aggregate produced by a hammer stroke accelerated over gravity capacity.

It is an object of the invention to provide a hammer centered on the guide for reducing side movements of the hammer and increasing the accuracy of the angle of the hammer blows.

It is an object of the invention to increase the efficiency of the hammer by isolating shock and reducing vibrations into supporting structures.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
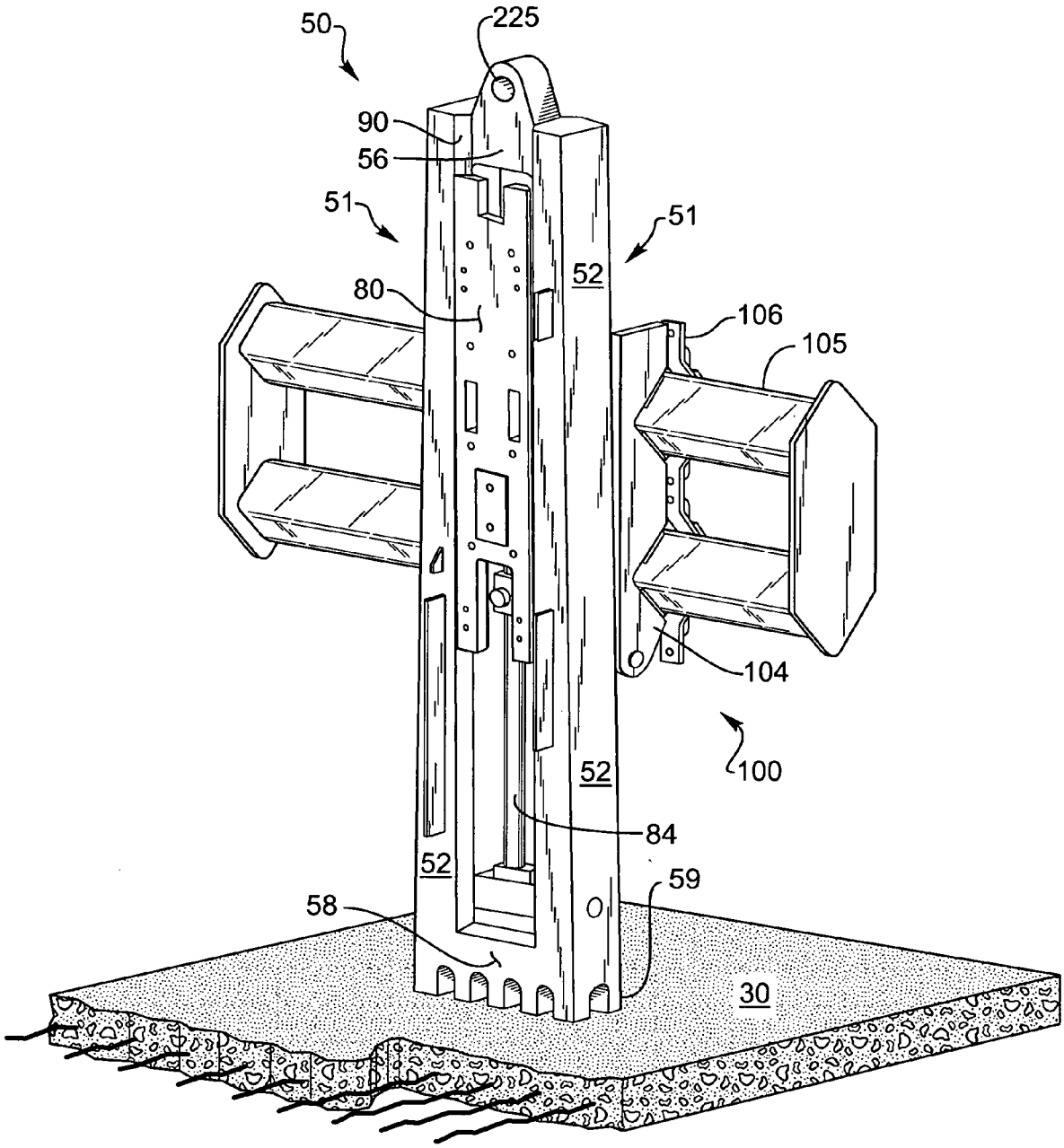
FIG. 1 is a front perspective view of the hammer assembly and mounting.
Figure 2:
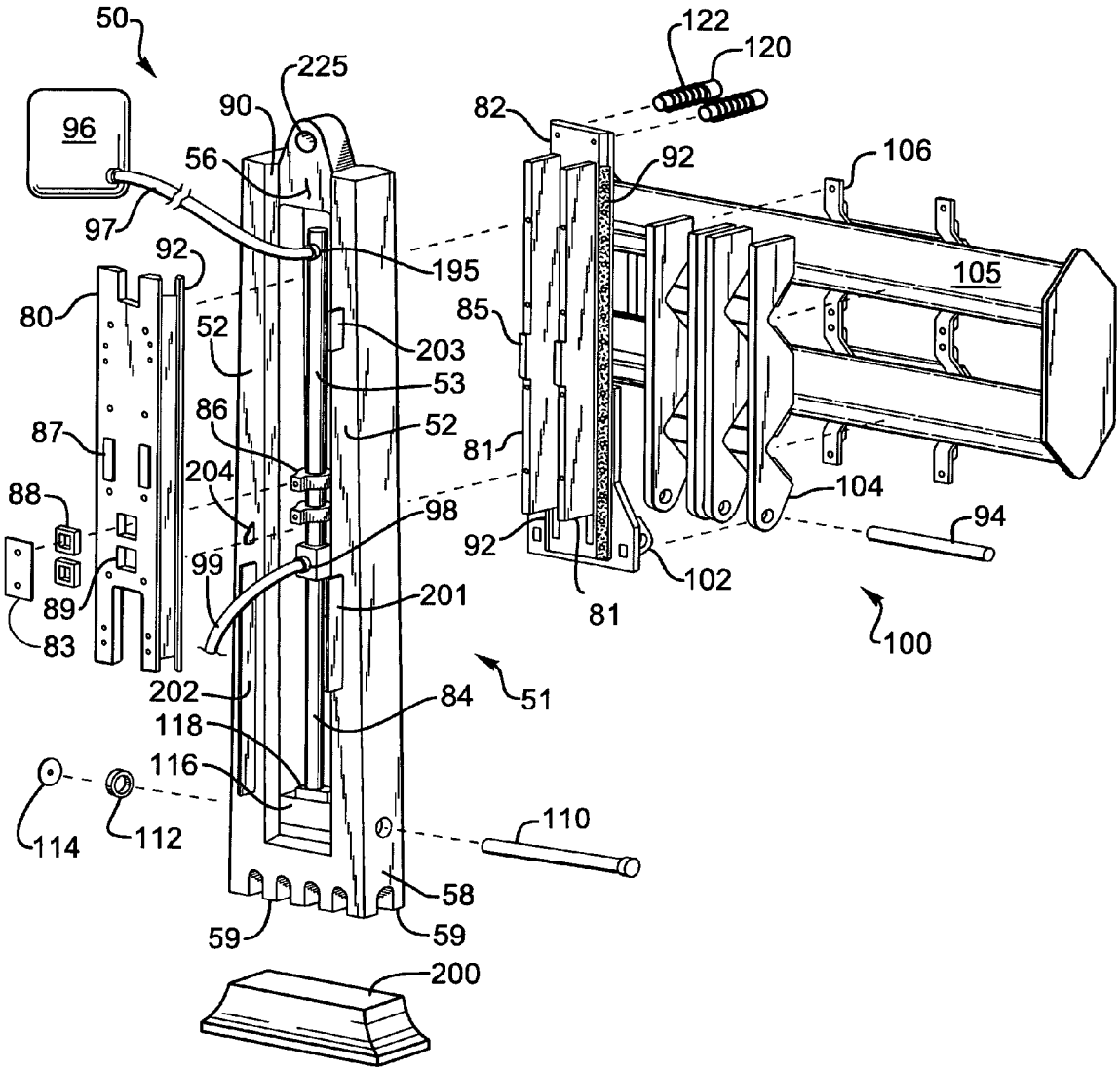
FIG. 2 is a front perspective exploded view of the hammer assembly.

A power hammer assembly 50 can be operated as a simple gravity drop hammer with hydraulic retract provided by hydraulic cylinder 53. The hammer mass 51 has a pair of arms 52 connected at the top by a header block 56 and at the bottom by a header block 58 with teeth 59. The hammer mass 51 has an angled face 90 along the inside facing edges of arms 52 for engaging the angled face guide plate plastic wear strips 92 on the outer guide plate 80 and the mounting guide plate 82. The guide plates 80, 82 operate on the inside edges of the arms 52 to keep the hammer aligned straight up and down relative to the guide plates. The angled face 90 along the arms 52 and angled face guide plate plastic wear strips 92 on the outer guide plate 80 and the mounting guide plate 82 are made of a high density plastic which provides smooth slippery surfaces to slide along as the hammer mass slides up and down relative to the guide plates 80, 82 while holding the hammer in place to limit side to side movements which can result in a reduction in the force applied to the concrete. The length of the angled face guide plate plastic wear strips 92 on the guide plates 80, 82 provide for stably holding the hammer mass 51 in place as it slides up and down on the guide plates 80, 82. The angled face guide plate plastic wear strips 90, 92 are preferably at 45 degrees to the face and side of the hammer mass 51.

The outer guide plate 80 has slots for spacers 87 for guide plate lugs 85 on the guide plate spacers 81 of mounting guide plate 82 thus locking the guide plates 80, 82 together to form a guide for stabilizing the hammer mass 51 as it moves up and down. The guide plate spacers 81 provide for the guide plates 80, 82 to surround the cylinder 53 and the piston 84 which is centered within the hammer mass 51. The piston rod 84 is connected to the hammer mass 51 at the header block 58 by a rod connection 110 passing through an aperture in the hammer mass 51 and the base of the piston 116. The pin has a rubber collar 112 to help reduce shock and a retainer 114, which secures the rod connection 110 in place. A cushion 118 can also be used on top of the piston base 116 to help reduce shock between the piston 84 and the hammer mass 51.

The hydraulic cylinder 53 and the piston 84 are centered in the hammer mass 51 which is centered in the guide plates 80, 82 to provide for forces straight up and down without wasted side to side or front and back motions to decrease the efficiency of the hammer. The center of mass of the hammer mass 51 is in line with the center of the hydraulic cylinder 53 and piston 84 so that the mass will tend to not tilt or twist the hammer assembly 50 during use which wastes energy and contributes to vibrations and wear.

The hydraulic cylinder 53 has cylinder mounting collars 86 mounted thereon for connecting the outer guide plate 80 thereto. The outer guide plate 80 has apertures 89 for engaging the cylinder mounting collars 86 and cylinder mounting shock absorbers 88 preferably made out of rubber for surrounding the cylinder mounting collars 86 and being between the cylinder mounting collars 86 and the aperture 89. A cover plate 83 keeps the cylinder mounting shock absorbers in place. Hydraulic line 99 connects from a hydraulic pump (not shown) to hydraulic valve 98 on the hydraulic cylinder 53 to power the hammer retract.

In one mode of operation the hydraulic cylinder 53 is only used to raise the piston 84 up into the cylinder 53 and the hammer mass 51 is then allowed to drop by gravity and hit the concrete to be broken up. The teeth 59 at the base of the foot 58 of the hammer mass 51 hits the concrete and first cracks and then breaks up the concrete. The teeth 59 being spaced apart allows space along the surface of the concrete for breaking up the concrete and increasing the shock at the point where the teeth impact the concrete.

The concrete to be broken up is placed on an anvil 200 to increase the shock induced in the concrete by the hammer mass 51. The shock of the hammer blow is reflected by the anvil 200, which helps crack and then break up the concrete.

In another embodiment the cylinder 53 is a duplex cylinder having $N_2$ (Nitrogen) compressed by the hydraulic lifting of the piston 84 in the hydraulic cylinder 53. The compressed $N_2$ exits valve 195 and flows though flex hose or piping 97 to reservoir 96 where it stays in compression until needed to accelerate the piston 84 downward to increase the impact of the hammer mass 51 over a gravity drop hammer. When it is desired to increase the impact of the hammer mass 51, valve 195 is opened and the compressed $N_2$ passes from the reservoir 96 through flex hose or piping 97 to the hydraulic cylinder 53 and applies force to the piston to accelerate the hammer mass and increase the impact on the concrete. The hydraulic cylinder 53 thereby stores hydraulic force in the form of compressed gas on the upstroke of the hammer mass 51 to be used later in the downstroke. $N_2$ is the preferred gas in a duplex hydraulic cylinder because it does not have a diesel effect acting with hydraulic oil leakage.

The hammer assembly 50 has a mounting hinge assembly 100 allowing for a pivotable connection to the mounting plates 104 by a mounting hinge pin 94 through apertures in the mounting hinge and apertures on the guide plate mounting 102. The pivoting of guide plate 82 allows the hammer mass to be tilted downward for servicing and for transportation. Further, the pivoting is useful for angling the feet 58 to be perpendicular to the concrete surface to be broken up. The top portion of guide plate mounting 82 has anti-bind rods 120 for adjusting the angle of the hinge mounting plate 92 and therefore the hammer mass 51. A spring 122 between the anti-bind rod 120 and the mounting plate 92 allows the foot 58 and teeth 59 to be angled slightly so as to be easier to lift off the concrete rather then be pinched by or angled into the concrete and thereby be caught and harder to lift out of the concrete. The hydraulic cylinder 53 then expends less energy lifting the hammer mass 51 after it impacts the concrete. The pivot angle for lift out is important when the hammer is on a moving vehicle since the concrete will be changing position under the hammer when the hammer teeth 59 are imbedded in the concrete.

The mounting bracket 104 is attached by bolting to the hinge mounting plate and to a mounting support 105 which is attached to a frame of a vehicle or a permanent structure by brackets 106 to mount the hammer assembly for use on a pavement recycling machine, a recycling machine for concrete products or another type of concrete breaking machine.

A plurality of hammer assemblies 50 attached to the mounting 105 each hitting at different times can efficiently break a road surface or other wide concrete product apart.

Actuator bars 201, 202, 203 and 204 are used in conjunction with sensors, which control the movement of the hammer by computer and valving Hoisting eye 225 is used in conjunction with a crane for lifting the hammer mass 51 out of the power hammer assembly 50 or placing the hammer mass 51 in the power hammer assembly 50. Since the hammer mass can be on the order of 2200 kilograms a crane is needed to assemble the power hammer assembly 50 and to replace worn or broken hammers.

Obviously, many modifications and variations of the present invention are possible in light of the above teachings. It is therefore to be understood that, within the scope of the appended claims, the invention may be practiced otherwise than as specifically described.

What is claimed is:

1. A hammer for use on steel reinforced concrete comprising:

a hammer mass having two spaced parallel arms connected by a header block at the top and a foot at the bottom, the two spaced parallel arms, header block and foot form a rectangular opening, the arms having angled inside corner faces on the rectangular opening, a front guide plate and rear guide plate each having angled corner edges for slidingly engaging the angled inside corner faces on the rectangular opening of the arms, the front and rear guide plates attach to each other though the rectangular opening, and slid up and down along the arms of the hammer mass, a hammer mounting frame, the rear guide plate pivotally attached to the hammer mounting frame near the base of the rear guide plate, for pivotally holding the hammer assembly, an hydraulic cylinder centered in the width of the hammer mass rectangular opening and attached to the guide plate, a piston containing the hydraulic cylinder and connected to the foot of the hammer such that the hydraulic cylinder moving in the piston moves the hammer mass relative to the guide plate, a rod attached to the rear of the rear guide plate for pivoting the rear guide plate on the pivot connection to the frame, thereby angling the hammer foot relative to an object being hammered, an anvil proximate the base of the foot of the hammer when the hydraulic cylinder is extended from the piston to place reinforced concrete on to subject the concrete to hammer blows.

2. A hammer for use on steel reinforced concrete as in claim 1 having, a spring along rod for allowing the rear guide to turn on the pivot such that the hammer can be removed from the concrete after an impact without binding in the concrete.

3. A hammer for use on steel reinforced concrete as in claim 1 having, a plurality of teeth on the base of the foot for impacting the concrete helping to distribute the impact force to fracture the concrete uniformly.

4. A hammer for use on steel reinforced concrete as in claim 1 wherein, the cylinder comprises a duplex cylinder for compressing gas when the hammer is raised such that the hammer is provided with greater velocity when dropped to provide more force to the hammer when it impacts the concrete.

5. A hammer for use on steel reinforced concrete as in claim 1 having, a shock absorbent material between the piston and the foot of the hammer to absorb some of the reflected shock of impact.

6. A hammer for use on steel reinforced concrete as in claim 1 having, a hard plastic lubricated material on the angled sliding surfaces of guides and the arms have plastic for promoting sliding contact between the arms of the hammer mass and the front and rear guides.

* * * * *